US005490123A

United States Patent [19]

Biver

[11] Patent Number: 5,490,123

[45] Date of Patent: Feb. 6, 1996

[54] WATCH CASE EXHIBITING A DETACHABLE BEZEL

[75] Inventor: Jean-Claude Biver, Villette/Cully, Switzerland

[73] Assignee: Blancpain S.A., Le Brassus, Switzerland

[21] Appl. No.: 229,403

[22] Filed: Apr. 18, 1994

[30] Foreign Application Priority Data

Apr. 20, 1993 [CH] Switzerland ..... 01200/93

[51] Int. Cl.[6] ..... G04B 37/00

[52] U.S. Cl. ..... 368/295; 368/294

[58] Field of Search ..... 368/294–296

[56] References Cited

U.S. PATENT DOCUMENTS

| | | | |
|---|---|---|---|
| 316,072 | 4/1885 | Smith . | |
| 1,050,394 | 1/1913 | Royer . | |
| 3,386,239 | 6/1968 | Shiffman | 368/294 |
| 3,583,151 | 6/1971 | Tissot | 58/91 |
| 4,505,598 | 3/1985 | Wolf et al. | 368/309 |
| 4,815,053 | 3/1989 | Busco | 368/294 |
| 5,005,161 | 4/1991 | Boilen | 368/295 |

FOREIGN PATENT DOCUMENTS

| | | |
|---|---|---|
| 2199598 | 4/1974 | France . |
| 9206015 | 7/1992 | Germany . |
| 118038 | 4/1927 | Switzerland . |

*Primary Examiner*—Bernard Roskoski

*Attorney, Agent, or Firm*—Griffin, Butler, Whisenhunt & Kurtossy

[57] ABSTRACT

This watch case includes a caseband (1), a detachable bezel (4) and bayonet means (8,9,10,11,12,13) for interlocking the bezel onto the caseband. Blocking means (6) are interposed between the bezel and the caseband when a predetermined rotation angle has been effected by the bezel, this in order to prevent any rotational movement of the bezel. Such blocking means include manual grasping means (7) enabling retraction of said blocking means, then disengagement of the bezel from the caseband by rotation initially and then translation.

6 Claims, 4 Drawing Sheets

WATCH CASE EXHIBITING A DETACHABLE BEZEL

The present invention is relative to a watch case including a caseband into which a crystal is fitted, a back cover and means for interlocking the bezel with the case band serving conjointly to assure axial retention of the bezel on the caseband when the bezel is given a rotational movement relative to the caseband.

BACKGROUND OF THE INVENTION

Patent CH-A-118 038 describes a watch case forming an outer envelope intended to receive a movement. Such outer envelope is made up of a back cover/caseband and of a bezel. In order to avoid the usual arrangement of a screw thread coupling them together, the use of a bayonet joint has been conceived in order to be able, during winding of the movement, to separate and reunite the back cover/caseband with the bezel without difficulty and rapidly. In order to attain this purpose, the bezel bears studs intended to fit into grooves formed in the back cover/caseband. This latter bears springs which project to the internal end of the grooves and behind which are engaged the studs having come to the end of the travel in such grooves. In this construction, it is sufficient to give the bezel an inverse rotational movement in order to disengage the bezel from the back cover/caseband. This system thus does not exhibit the safety arrangement preventing an untimely rotational movement which could accidentally come to free the movement.

SUMMARY OF THE INVENTION

Although the detachable bezel of the present invention seeks to attain a purpose entirely different from that of the document cited hereinabove, its bezel is also assembled onto the caseband according to an analogous principle. However, the combination of the invention includes a safety arrangement preventing all backward movement of the bezel and thus all untimely disengagement of the latter. For this the watch case of the invention is characterized by the fact that it includes blocking means interposing between between the bezel and the caseband when a predetermined rotation angle has been effected by the bezel, this in order to prevent all rotational movement of said bezel, the blocking means including manual grasping means enabling retraction of said blocking means, then disengagement of the bezel from the caseband by rotation initially and then translation.

The invention is now to be explained by the description of an embodiment given by way of example which description is illustrated by the drawings.

DESCRIPTION OF THE PREFERRED EMBODIMENT

Figure 1:
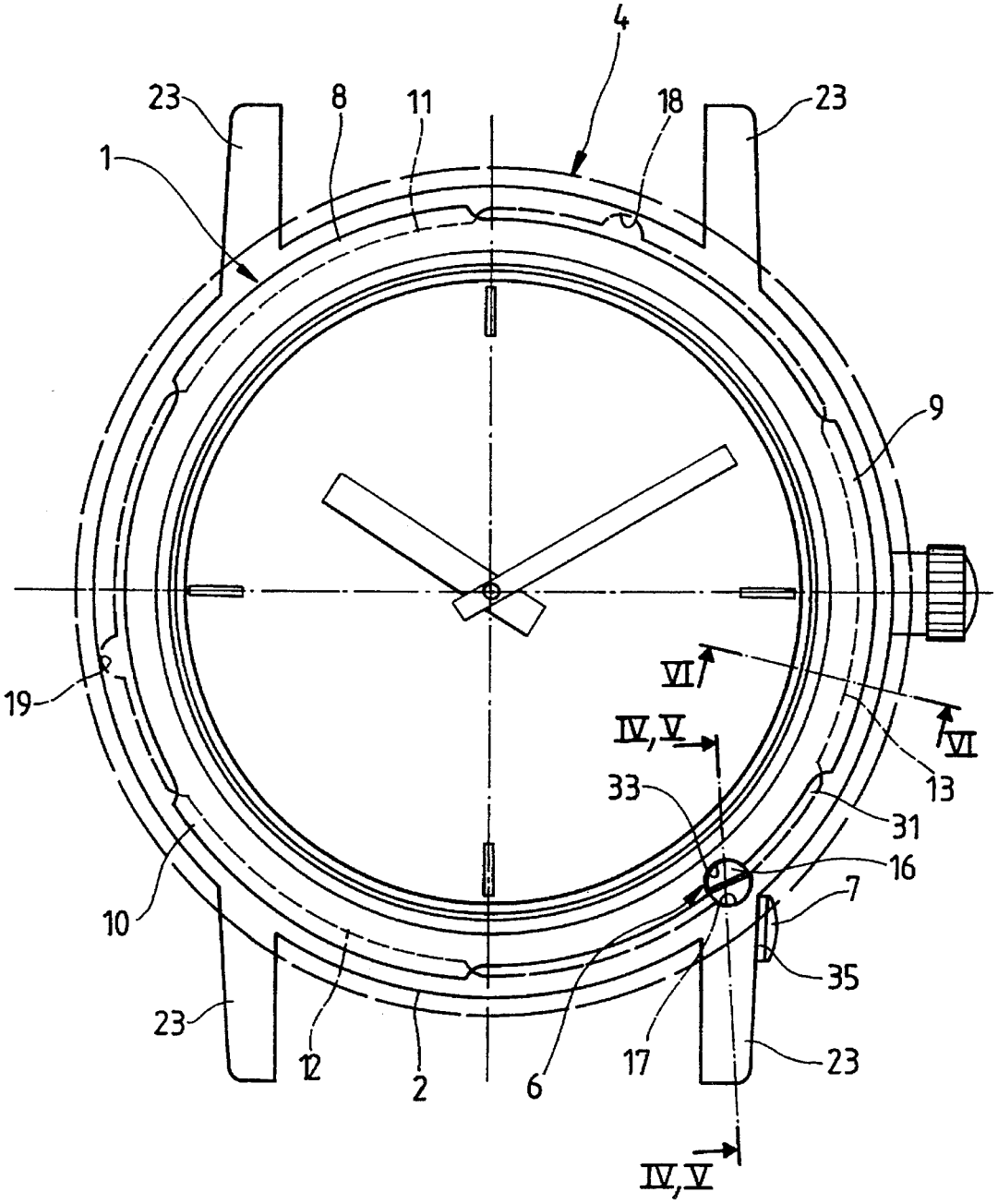
FIG. 1 is a plan view from above of the watch case according to the invention.
Figure 4:
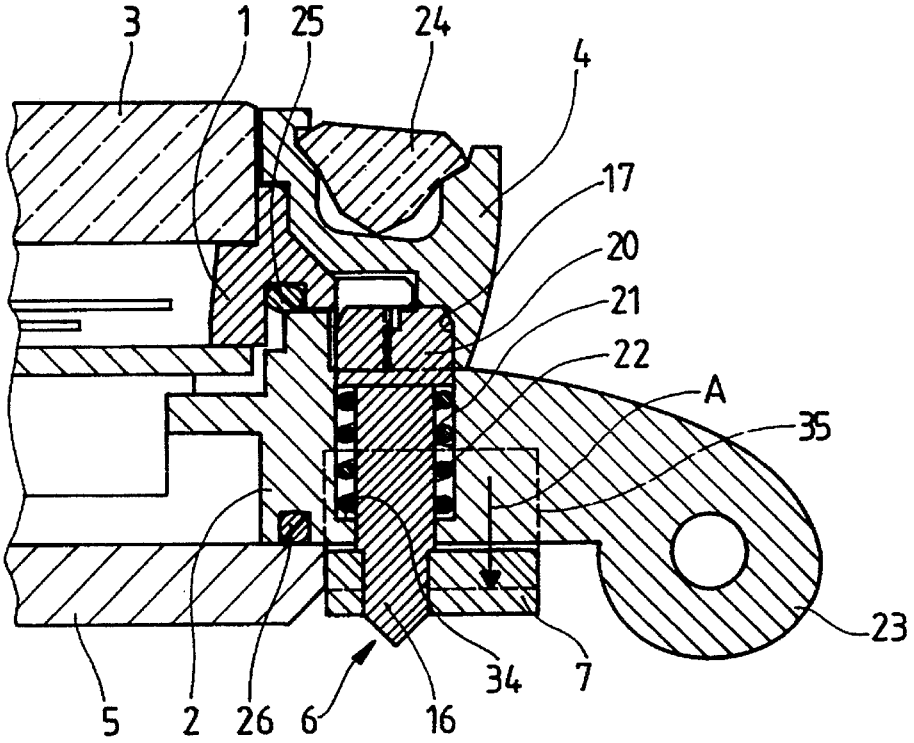
FIG. 4 is a cross-section along line IV—IV of FIG. 1 showing the blocking means engaged.

In a completely general manner, and in particular, FIGS. 1 and 4 show that the watch case includes a caseband here formed in two parts 1 and 2 snap fitted into one another, between which parts is interposed a water-resistant packing 25. It will be observed that such caseband could be formed in a single piece. Part I is that which contributes specifically to the attachment of bezel 4. A crystal 3 is fitted into caseband 1. A detachable bezel 4 surmounts caseband 1 and surrounds crystal 3. The case is closed by a back cover 5 fixed on a snap (not shown) of caseband 2. A packing 26 assures water resistance of the back cover 5. It will be noted that back cover 5 could be integrally formed with the caseband, thus rendering superfluous use of the packing 26.

Figure 6:
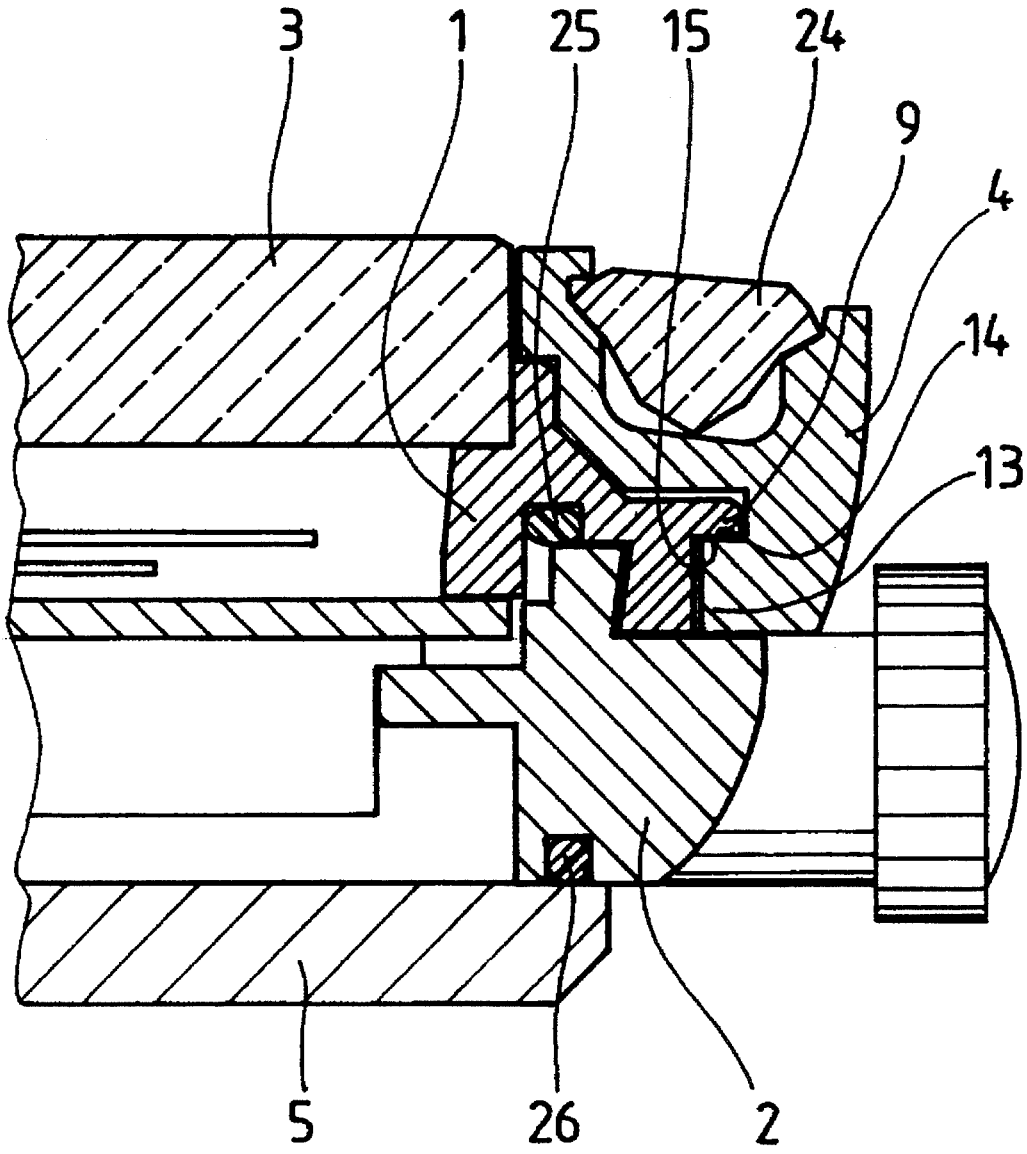
FIG. 6 is a cross-section along line VI—VI of FIG. 1.

FIGS. 1 and 6 show particularly well that the bezel 4 includes interlocking means 11, 12 and 13 which cooperate with interlocking means 8, 9 and 10 borne by caseband 1, such interlocking means conjointly serving to assure axial retention of the bezel 4 onto caseband 1 when the bezel is given a rotational movement relative to the caseband. Such interlocking and axial retention means will be described in detail further on.

The invention is mainly characterized by the fact that it comprises blocking means 6 which are interposed between bezel 4 and caseband 1 when a predetermined rotation angle has been effected by the bezel, this with the purpose of preventing all rotational movement of such bezel. Such blocking means appear clearly on FIGS. 1 and 4 and will be described in detail hereinafter. The same figures show also that the blocking means 6 comprise manual grasping means 7 permitting retraction of the blocking means which enables disengagement of the bezel from the caseband by rotation initially and then by translation.

Figure 3:
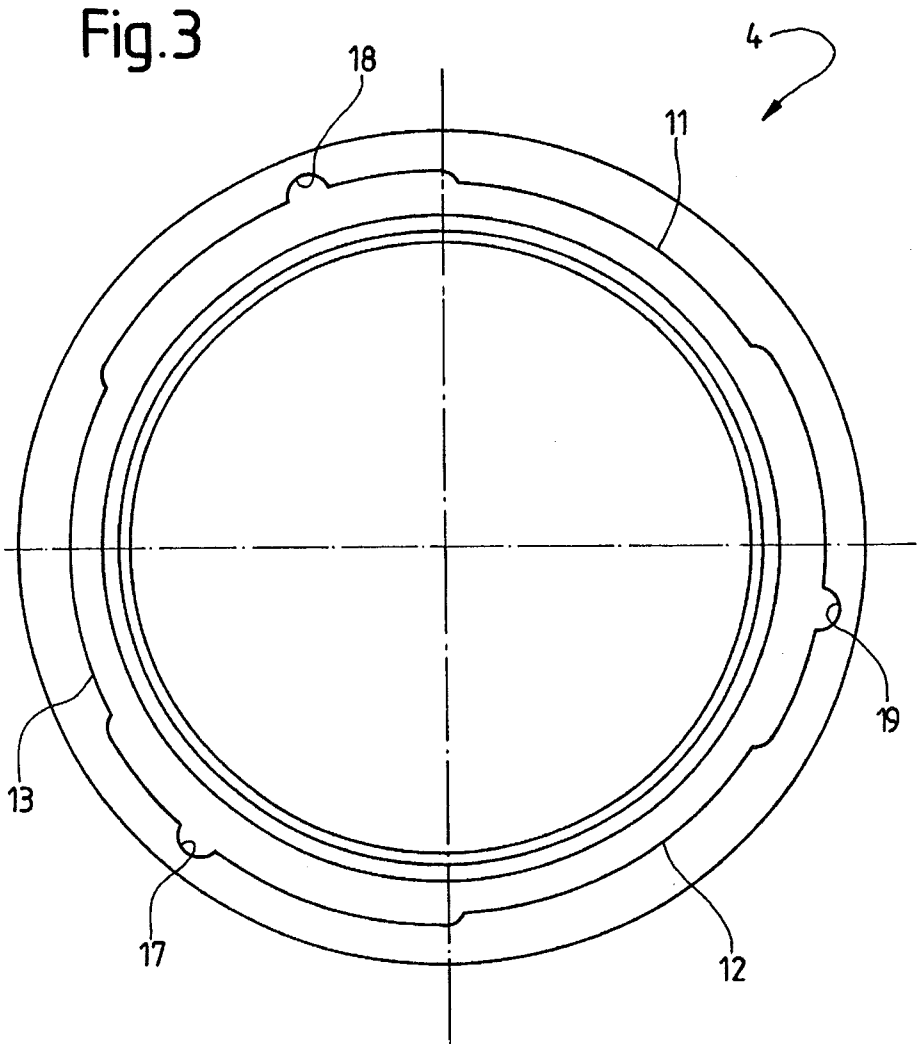
FIG. 3 is a plan view from below of the bezel shown on the case of FIG. 1.
Figure 2:
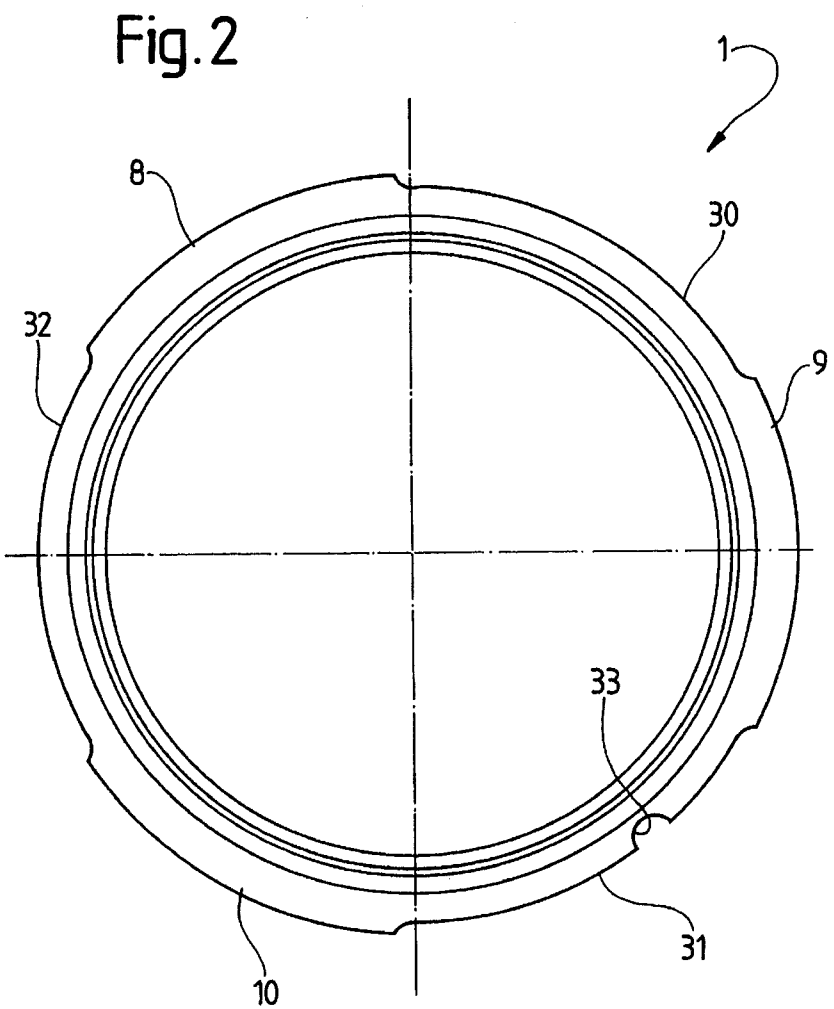
FIG. 2 is a plan view from above of the caseband of the case shown on FIG. 1.

More specifically, and in the example shown on the drawing, the interlocking and then axial retention of the bezel on caseband 1, is of the bayonet type. FIG. 2 is a top view of caseband 1. Such caseband includes one or several projections, three projections 8, 9 and 10 in the embodiment as shown, uniformly distributed over the exterior periphery of caseband 1. FIG. 3 is a view from below of bezel 4. Such bezel includes one or several projections, in the present case three projections 11, 12 and 13, uniformly distributed over the interior periphery of such bezel. In order to introduce the bezel 4 onto caseband 1, and starting with FIGS. 2 and 3, the bezel 4 is turned over through 180° and is placed on caseband 1 in causing it to rotate by 60°. At this instant, the projection 11 of the bezel penetrates into the free space 32 located between the two projections 8 and 10 of the caseband. It is the same in this example for projection 12 which penetrates into space 31 and projection 13 which penetrates into space 30. If now the bezel is rotated by 60° in the inverse sense, there will be obtained the axial latching of the bezel shown on FIG. 1 since, as is well shown by FIG. 6, the upper face 14 of projection 13 borne by bezel 4 is engaged under the lower face 15 of projection 9 borne by caseband 1.

Figure 5:
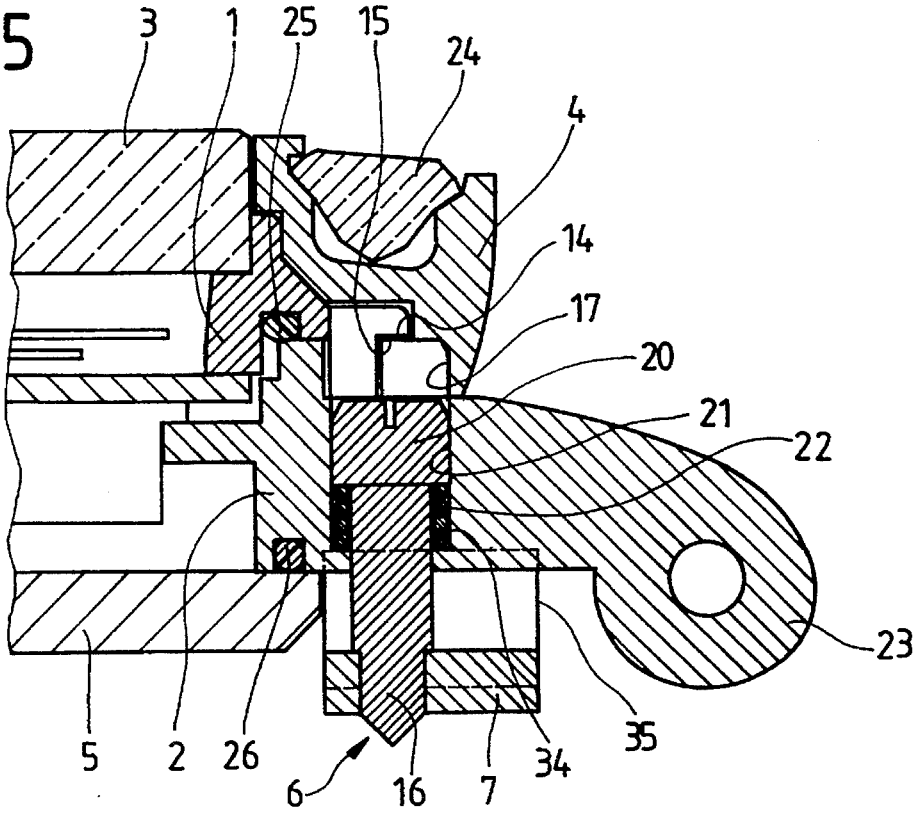
FIG. 5 is a cross-section along line V—V of FIG. 1 showing the blocking means disengaged.

As shown by FIGS. 1, 4 and 5, the blocking means which are the basic objective of the present invention, consist of a finger 16 traversing the casebands 1 and 2 in the direction of their height. As is shown on figure 3, bezel 4 includes at least one seat 17, 18 or 19, three seats equally distributed over the outer periphery of the bezel being provided in the embodiment shown, such seats being arranged between the projections 11, 12 and 13 of the bezel. As to the blocking finger 16, this is arranged between the two projections 9 and 10 of caseband 1 and emerges from a hollow 33 provided in the latter. Such finger can penetrate into one of seats 17, 18 or 19 formed in the bezel 4 (see also FIG. 3). Hereinafter there will be explained in a more detailed manner how such finger prevents rotation of the bezel.

FIGS. 4 and 5, which are cross-sections along lines IV,V—IV,V of FIG. 1 show in detail an embodiment of the blocking means 6 using finger 16. Such finger includes a head 20 at one of its ends and a tongue 7 forming grasping and stopping means at its other end. It is adapted to slide on the interior of a bore 21 formed in the caseband 2 against the return force of a spring 22. The spring is placed between a lower shoulder 34 of the bore 21 and the under portion of head 20. The stopping tongue 7 is screwed on or glued to the end of the finger. Finger 16 could be arranged at any place on the caseband. However, it has been preferred to benefit from the presence of lugs 23 contiguous to the caseband 2 in order to house finger 16 within one among them. This enables better guidance of finger 16. Furthermore, in order to avoid that the finger 16 rotate, the tongue 7 has been provided with a plate 35 adapted to slide along the wall of lug 23. The stopping tongue 7 laterally projects beyond plate 35 as is visible on FIG. 1 in a manner such that tongue 7 offers a good engagement for a fingernail which, by bearing on it in a sense perpendicular to FIG. 1 and according to arrow A visible on FIG. 4, is adapted to retract finger 16 in bringing it to the position shown on FIG. 5. FIGS. 4 and 5 show further that the travel of finger 16 is arranged so as to completely disengage head 20 out of seat 17 formed in the bezel, when a manual thrust is applied to tongue 7 along arrow A. From this instant, the bezel is entirely free to be driven in rotation on the caseband.

In applying bezel 4 onto caseband 1 in the manner which has been described hereinabove, projection 12 (as well as the other projections 11 and 13) of bezel 4 penetrate into space 31 (and respectively into spaces 30 and 32) of caseband 1 and finger 16 automatically plunges into bore 21, also under the action of projection 12. It is thus understood that finger 16 plunges and is retracted in bore 21 at the same time as the bezel 4 is axially put into place on caseband 1, 2, so that a single and unique operation is necessary without additional action, for example on tongue 7. It will also be noted that such posing operation simultaneously enables placing spring 22 under stress by compression. Next, in rotating bezel 4 in the clockwise or anti-clockwise sense, the projections of the bezel are caused to penetrate under the respective projections of the caseband until one of the seats, for example 17 of bezel 4 arrives opposite hollow 33 in which the finger 16 can move in translation. At such exact instant, the finger penetrates into seat 17, urged as it is by spring 22 in causing a slight click sound to be heard. The bezel is then blocked and the situation is that shown on FIG. 4. From this moment on, the bezel will only be capable of being unblocked by retracting the finger in exerting on tongue 7 a thrust according to arrow A. When finger 16 will have been entirely retracted (see FIG. 5) it will then be possible to rotate the bezel until its projections are disengaged from the projections of the caseband, from which point the bezel will be separable from the caseband.

It has been indicated in the introduction to this description that the purpose of the invention is different from that sought to be attained in the cited document CH- A-118 038. Effectively, the cited document concerns a case intended to protect a movement including its winding crown. It is thus necessary to be able easily to open the case in order to wind the watch. The present invention concerns only the ability to remove the bezel of the watch in an easy manner and this with the purpose of replacing it by another or other bezels, for example purchased as accessories, in order to modify the appearance of the watch in the light of circumstances. If the case is fashioned of precious metal, the bezel can be covered with diamonds 24 (see FIGS. 4 and 5). One bezel as provided could be covered by diamonds, another, for example by coloured precious stones. But the invention is not limited to luxury cases and can be extended to fantasy cases, even of plastic material.

What I claim is:

1. A watch case including a caseband into which a crystal is fitted, a detachable bezel surmounting the caseband and surrounding the crystal, a back cover and means for interlocking the bezel with the caseband serving conjointly for axial retention of said bezel on said caseband when the bezel is given a rotational movement relative to the caseband, and further including blocking means, interposing between the bezel and the caseband when a predetermined rotation angle has been effected by the bezel, for preventing all rotational movement of said bezel, said blocking means being slidably mounted in said caseband and including manual grasping means enabling retraction of said blocking means, then disengagement of the bezel from the caseband by rotation initially and then translation.

2. A watch case as set forth in claim 1, wherein said means for interlocking the bezel with the caseband is of the bayonet type, the caseband including one or several projections distributed around its outer periphery and the bezel including one or several corresponding projections distributed around its inner periphery, the upper face or faces of the projection or projections borne by the bezel being locked under the lower face or faces of the projection or projections borne by the caseband whenever the bezel is axially retained on the caseband, the blocking means including a finger traversing the caseband in the direction of its height and adapted to fit into a seat formed in the bezel for preventing rotation thereof.

3. A watch case as set forth in claim 2, wherein the bezel and the caseband each bear three projections and the bezel comprises three seats uniformly distributed on its inner periphery, said seats being arranged between the projections of the bezel and the finger being arranged between two projections of the caseband.

4. A watch case as set forth in claim 1, fashioned of precious metal, the bezel being covered with precious stones.

5. A watch case including a caseband into which a crystal is fitted, a detachable bezel surmounting the caseband and surrounding the crystal, a back cover and means for interlocking the bezel with the caseband serving conjointly for axial retention of said bezel on said caseband when the bezel is given a rotational movement relative to the caseband, and further including blocking means interposing between the bezel and the caseband when a predetermined rotation angle has been effected by the bezel, this in order to prevent all rotational movement of said bezel, the blocking means including manual grasping means enabling retraction of said blocking means, then disengagement of the bezel from the caseband by rotation initially and then translation, the interlocking of the bezel with the caseband being of the bayonet type, the caseband including one or several projections distributed around its outer periphery and the bezel one or several corresponding projections distributed around its inner periphery, the upper face or faces of the projection or projections borne by the bezel being locked under the lower face or faces of the projection or projections borne by the caseband whenever the bezel is axially retained on the caseband, the blocking means including a finger traversing the caseband in the direction of its height and adapted to fit into a seat formed in the bezel for preventing rotation thereof, the bezel and the caseband each bearing three projections and the bezel comprising three seats uniformly distributed on its inner periphery, said seats being arranged between the projections of the bezel and the finger being arranged between two projections of the caseband the finger including a head at one of its ends and a tongue forming grasping and stopping means at its other end, said finger being adapted to slide within a bore formed in the caseband against the return force of a spring placed in said bore and under the head of the finger, the travel of the finger being arranged to disengage completely said head from the seat formed in the bezel when manual traction is exerted on said tongue.

6. A watch case as set forth in claim 5, and further comprising bearing lugs for attaching a bracelet, the bore formed in the caseband being located at the origin of one of the lugs and traversing such entirely.

* * * * *